US009822934B2

(12) United States Patent
Vollkommer et al.

(10) Patent No.: US 9,822,934 B2
(45) Date of Patent: Nov. 21, 2017

(54) LAMP HAVING A GLASS BULB AND SEMICONDUCTOR LIGHT SOURCE

(71) Applicant: OSRAM GmbH, Munich (DE)

(72) Inventors: Frank Vollkommer, Gauting (DE); Gerhard Doell, Augsburg (DE); Philipp Erhard, Mering (DE)

(73) Assignee: Ledvance GmbH (DE)

( * ) Notice: Subject to any disclaimer, the term of this patent is extended or adjusted under 35 U.S.C. 154(b) by 0 days.

(21) Appl. No.: 15/049,187

(22) Filed: Feb. 22, 2016

(65) Prior Publication Data

US 2016/0245477 A1 Aug. 25, 2016

(30) Foreign Application Priority Data

Feb. 23, 2015 (DE) ..... 10 2015 203 214

(51) Int. Cl.

| | |
|---|---|
| ***F21K 99/00*** | (2016.01) |
| ***F21K 9/27*** | (2016.01) |
| ***F21V 3/04*** | (2006.01) |
| ***F21K 9/69*** | (2016.01) |
| *F21Y 103/10* | (2016.01) |
| *F21Y 115/10* | (2016.01) |

(52) U.S. Cl.

CPC ..... *F21K 9/27* (2016.08); *F21K 9/69* (2016.08); *F21V 3/04* (2013.01); *F21Y 2103/10* (2016.08); *F21Y 2115/10* (2016.08)

(58) Field of Classification Search

None

See application file for complete search history.

(56) References Cited

U.S. PATENT DOCUMENTS 6,796,680 B1 * 9/2004 Showers ..... F21V 15/013 362/240
2006/0028837 A1 * 2/2006 Mrakovich ..... G02B 6/001 362/602
2009/0219713 A1 9/2009 Siemiet et al.

(Continued)

FOREIGN PATENT DOCUMENTS

DE 102012210742 A1 1/2014
DE 102014102686 A1 9/2015

(Continued)

OTHER PUBLICATIONS

German Search Report based on application No. 10 2015 203 214.0 (8 paged) dated Sep. 29, 2015 (for reference purpose only).

*Primary Examiner* — Ashok Patel
(74) *Attorney, Agent, or Firm* — Hayes Soloway PC

(57) ABSTRACT

A lamp includes a tubular glass bulb with open end sides, at least one elongate carrier, inserted into the glass bulb, for at least one light strip, at least one elastic diffuser layer which is introduced into the glass bulb, and two bases which are fitted onto the open end sides of the glass bulb. The at least one light strip has a strip-shaped circuit board with a front-side conduction structure and with at least one semiconductor light source which is electrically connected thereto. The conduction structure is electrically connected to at least one of the bases. The at least one diffuser layer arches over the at least one semiconductor light source and the at least one conduction structure in a contact-free fashion at least over a length between the bases. The at least one diffuser layer is latched to the at least one carrier.

12 Claims, 7 Drawing Sheets

(56) References Cited

U.S. PATENT DOCUMENTS

| | | | | |
|---|---|---|---|---|
| 2010/0073929 | A1* | 3/2010 | Gingrich, III | F21S 2/005 362/249.01 |
| 2011/0199005 | A1* | 8/2011 | Bretschneider | F21V 7/22 315/152 |
| 2012/0008315 | A1* | 1/2012 | Simon | F21V 21/005 362/217.13 |
| 2014/0061684 | A1* | 3/2014 | Marutani | H01L 33/62 257/88 |
| 2014/0175492 | A1* | 6/2014 | Steranka | H01L 33/50 257/98 |
| 2015/0124443 | A1* | 5/2015 | Reingruber | F21V 29/004 362/235 |

FOREIGN PATENT DOCUMENTS

| | | | |
|---|---|---|---|
| WO | 2013179227 | A2 | 12/2013 |
| WO | WO/2014/001112 | * | 1/2014 |
| WO | 2014135357 | A1 | 9/2014 |

* cited by examiner

LAMP HAVING A GLASS BULB AND SEMICONDUCTOR LIGHT SOURCE

CROSS-REFERENCE TO RELATED APPLICATION

This application claims priority to German Patent Application Serial No. 10 2015 203 214.0, which was filed Feb. 23, 2015, and is incorporated herein by reference in its entirety.

TECHNICAL FIELD

Various embodiments relate generally to a lamp having a tubular glass bulb with open end sides, at least one elongate carrier, inserted into the glass bulb, for at least one light strip, at least one elastic diffuser layer which is introduced into the glass bulb, and two bases which are fitted onto the open end sides of the glass bulb, wherein the at least one light strip has a strip-shaped circuit board with a front-side conduction structure and with at least one semiconductor light source which is electrically connected thereto, the conduction structure is electrically connected to at least one of the bases, and the at least one diffuser layer arches over the at least one semiconductor light source and the at least one conduction structure at least over a length between the bases. Various embodiments can be applied, for example, to retrofit lamps with at least one semiconductor light source, in particular for replacing tubular lamps such as fluorescent lamps, fluorescent tubes, linear lamps, flashlights etc.

WO 2014/135357 A1 discloses a lighting device which has: a lamp tube with two open ends, a dynamo or "light engine" arranged in the lamp tube, a carrier which bears the dynamo and two end caps for closing off the open ends, wherein the lighting device also has a diffuser, the carrier which bears the dynamo is secured to the diffuser, and the diffuser is secured to an inner wall of the lamp tube. The diffuser may be embodied in an elastic fashion and bear against the inner wall of the lamp tube by means of internal tension, wherein the internal tension is generated by rolling the diffuser and has the effect of returning the diffuser to a planar state. In this context it is disadvantageous that in the event of a fracture of the lamp tube the lighting device can fall apart in such a way that exposed electrical leads are produced.

WO 2013/179227 A2 relates to a housing for an electric device, wherein an internal surface of the housing has a conductive pattern which makes available at least one conductor track, wherein the conductor track is arranged in such a way that it makes available a local electrical connection from the housing to at least one surrounded electrical component of the electric device and/or vice versa, wherein the conductive pattern is securely fastened to the inner surface of the housing, with the result that the conductive pattern fractures if the housing wall fractures where the conductive pattern is attached.

SUMMARY

A lamp includes a tubular glass bulb with open end sides, at least one elongate carrier, inserted into the glass bulb, for at least one light strip, at least one elastic diffuser layer which is introduced into the glass bulb, and two bases which are fitted onto the open end sides of the glass bulb. The at least one light strip has a strip-shaped circuit board with a front-side conduction structure and with at least one semiconductor light source which is electrically connected thereto. The conduction structure is electrically connected to at least one of the bases. The at least one diffuser layer arches over the at least one semiconductor light source and the at least one conduction structure in a contact-free fashion at least over a length between the bases. The at least one diffuser layer is latched to the at least one carrier.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
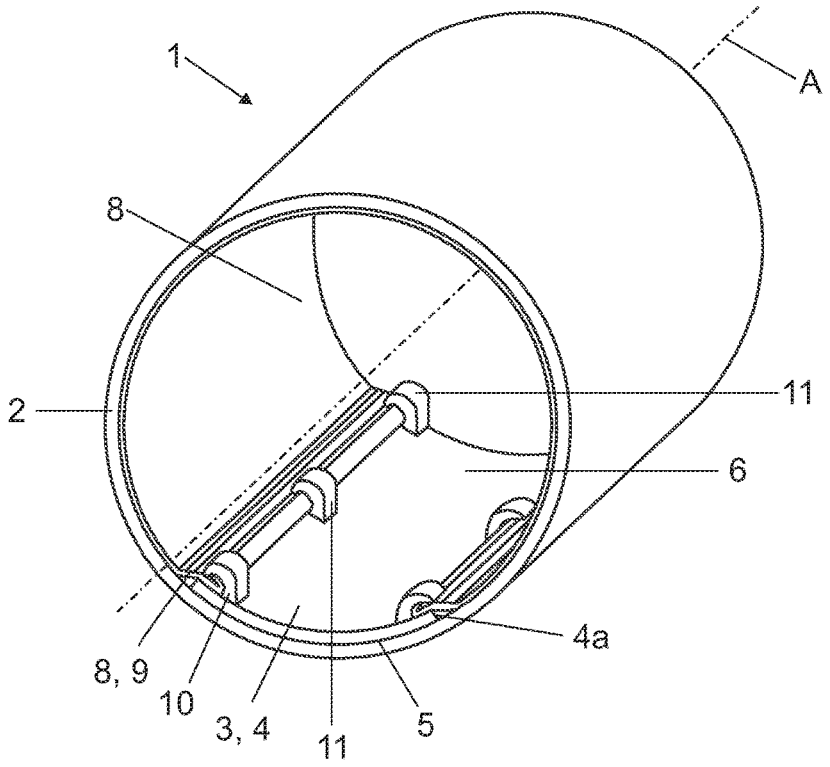
FIG. 1 shows an oblique front view of a detail of a lamp according to a first embodiment.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

Various embodiments may overcome at least partially the disadvantages of the prior art and may make available, e.g. with simple and economical means, a lamp which has a tubular glass bulb and which has improved protection against electric shocks in the event of a bulb fracturing.

Various embodiments provide a lamp having a tubular glass bulb with open end sides, at least one elongate carrier, inserted into the glass bulb, for at least one light strip, at least one elastic diffuser layer which is introduced into the glass bulb, and two bases which are fitted onto the open end sides of the glass bulb. The at least one light strip has a strip-shaped circuit board with a conduction structure at least on the upper side or front side and with at least one semiconductor light source which is electrically connected to the conduction structure. The conduction structure is electrically connected to at least one of the bases. The at least one diffuser layer arches over the at least one semiconductor light source and the at least one conduction structure at least over a length between the bases, with the result that the components and/or structures over which the arching occurs cannot be touched and are therefore protected from direct contact. The at least one diffuser layer is latched to the at least one carrier.

This lamp may provide the effect that even when the glass bulb has burst and is therefore at least partially removed, the conduction structure and the at least one semiconductor light source are protected against direct contact by the combination of the diffuser layer and carrier which serve as a protective enclosure. The latching of the diffuser layer and carrier then ensures a fixed connection, with the result that these two components do not become detached from one another even when the glass bulb fractures. The latching can lead, for example, to a comparatively rigid structure which is, for example, self-supporting. It may be possible to dispense with adhesive for connecting the components, with the result that damaging evaporation also does not form in the glass bulb. In addition, a latching arrangement is easy and cost-effective to manufacture.

The glass bulb allows light to pass through at least in certain areas. It may be transparent and/or translucent or opaque.

The glass bulb is, for example, linear. It has, for example, a hollow cylindrical basic shape, for example as a profile with a circular-ring-like cross-sectional shape. It may have a rolled portion at an end-side section or in the region of its open end sides, for the purpose of simplified plugging on of the respective base.

The base (which can also be referred to as a "closure cap") may permit mechanical securement and, under certain circumstances, also an electrical connection to a suitable socket. A driver for operating the at least one semiconductor light source may be accommodated in at least one of the bases, for example, if this base is also designed to connect electrically to a suitable lamp socket. The bases may be of identical or different design. A base may therefore be designed only for performing mechanical securement while the other base is designed to perform mechanical securement and form electrical contacts. The base or bases may be embodied, for example, as a pin base (for example as a bi-pin base) or as a bayonet cap or constitute such a base or cap.

The lamp may generally be a semiconductor retrofit lamp. A semiconductor retrofit lamp or semiconductor replacement lamp is understood to be, for example, a lamp with at least one semiconductor light source for replacing a conventional lamp. The retrofit lamp may have at least approximately a shape factor of the conventional lamp and also fit in the corresponding lamp sockets. The retrofit lamp may be designed, for example, to replace tubular lamps such as fluorescent lamps, fluorescent tubes, linear lamps, flashlights etc. In various embodiments, in this respect, the glass bulb may correspond to a conventional T type, for example of the type T2, T4, T5, T8, T10 or T12. In various embodiments for the use as semiconductor retrofit lamp, the base or bases may be embodied at least with external conformity with a conventional base or cap, for example with a pin base of the type G5 or G13, or form such a base or cap.

The lamp may have a plurality of longitudinal carriers which have been fitted, for example, in series into the glass bulb. Adjacent carriers may be connected to one another. A plurality of carriers may be latched to a common diffuser layer. The presence of a plurality of carriers may also be considered to constitute the presence of a multi-piece carrier.

The at least one carrier may be virtually rigid or flexible. A flexible carrier may be elastic, elastic-plastic or plastically flexible.

One or more diffuser layers may also be accommodated, for example in series, in the glass bulb.

The at least one carrier may bear one or more light strips, for example on just one side. At least one light strip may be equipped with at least one semiconductor light source on one side (for example the upper side or front side) or on both sides. In various embodiments, the circuit board of the light strip may be equipped at least on its upper side or front side and bear with its underside or rear side on the carrier, for example over a surface.

The conduction structure is embodied, for example, as a metallization and may have one or more conductor tracks and/or one or more contact fields. It may have, for example, contact fields for making contact with the at least one semiconductor light source and/or at least one base.

The circuit board may be virtually rigid or flexible. It may have conventional circuit board material as the base material, for example FR4. It may alternatively have, for example, a plastic film as the base material, for example if it is embodied in an elastically flexible fashion.

Given the presence of a plurality of light strips, these may be connected at least electrically to one another, for example via cables or plug-type connections.

In various embodiments, the at least one semiconductor light source includes at least one light-emitting diode. Given the presence of a plurality of light-emitting diodes, they can illuminate in the same color or in different colors. One color may be monochrome (for example red, green, blue, etc.) or multichrome (for example white). The light which is emitted by the at least one light-emitting diode can also be an infrared light (IR-LED) or an ultraviolet light (UV-LED). A plurality of light-emitting diodes can generate a mixed light; for example a white mixed light. The at least one light-emitting diode may contain at least one wavelength-converting luminescent material (conversion LED). The luminescent material may be alternatively or additionally arranged at a distance from the light-emitting diode ("remote phosphor"), for example even in the film. The at least one light-emitting diode can be present in the form of at least one individually housed light-emitting diode or in the form of at least one LED chip. The at least one light-emitting diode can be equipped with at least one separate and/or common optical system for guiding beams, for example at least one Fresnel lens, collimator, and so on. Instead of, or in addition to, inorganic light-emitting diodes, for example based on InGaN or AlInGaP, organic LEDs (OLEDs, for example polymer OLEDs) may also generally be used. Alternatively, the at least one semiconductor light source can have, for example, at least one laser diode.

In the event of the at least one semiconductor light source having at least one LED, the light strip may also be referred to as a "LED strip". LED strips are available with a rigid or mechanically flexible circuit board, for example within the scope of the LINEARlight or LINEARlight FLEX product family from Osram or within the scope of the PrevaLED Linear or PrevaLED Flex product family from Osram.

At least in certain regions, the diffuser layer allows light to pass through in a light-scattering fashion, for example allows light to pass through in a fashion which scatters light over the entire surface. The light-scattering effect can for example be advantageously used in conjunction with a transparent glass bulb. The diffuser layer extends, for example, over the entire length of the glass bulb or as far as a rolled portion of the rolled tube.

The diffuser layer is composed, for example, of plastic as a base material in which at least one light-scattering filler material is distributed.

There is one development in which the diffuser layer is elastically flexible, since in this way it may particularly easily be changed to a predetermined shape, for example to a base shape which is rolled in the form of a tube. It may in this context be so rigid that after being rolled up around a longitudinal axis it automatically unrolls again, for example automatically returns to a planar state. The diffuser layer may alternatively be so thin that after rolling up it does not unroll, or does not unroll completely automatically again.

There is also a development in which the diffuser layer bears at least partially (for example for the most part) in a conformed fashion against an inner side of the glass bulb, because in this way particularly precise and stable positioning is achieved with simple means. The secure bearing against the bulb tube is greatly facilitated by the elastic flexibility. The diffuser layer may have a rectangular shape in an unrolled or planar state.

The diffuser layer has, for example, a thickness between 0.075 mm and 0.5 mm, for example of approximately 0.1 mm, and may then also be referred to as a "diffuser film".

The diffuser layer may additionally or alternatively also have at least one other function, for example at least partially serve as an organic solar cell or as a carrier for at least one organic solar cell, serve as a color filter etc.

The fact that the diffuser layer arches over the at least one semiconductor light source and the at least one conduction structure with direct-contact protection may include, for example, virtually no semiconductor light source and no part of the conduction structure being capable of being touched, for example not by a human finger, at the section of the light strip over which arching occurs. Possible gaps between the carrier and the diffuser film are kept so small that a finger or the like does not fit through them.

There is a refinement in which the at least one carrier corresponds to the at least one circuit board. By dispensing with a dedicated carrier, the number of parts of the lamp are reduced and assembly is simplified. The at least one diffuser layer is then therefore latched, for example, directly to the at least one circuit board of the light strip.

There is also a refinement in which the lamp has precisely one carrier and precisely one diffuser layer. This permits a particularly stable and gap-free design. There is a development in which precisely one diffuser layer is latched directly to precisely one circuit board of the light strip (that is to say the circuit board also serves as a carrier), since in this way a particularly simple and mechanical design is obtained.

There is a further refinement in which the at least one diffuser layer is inserted bent in a tubular fashion into the glass bulb and is latched, in the region of its longitudinal edges, to the carrier. This makes possible a particularly stable design which is easy to implement and permits the diffuser film to bear on an inner side of the glass bulb in a conformed fashion which is easy to implement.

It is yet a further refinement that the carrier has, in the region of its two longitudinal sides, in each case at least one latching hook, into which latching hook the diffuser layer is latched. Particularly simple latching is made possible in this way. The latching hooks are, for example, arranged further toward the longitudinal sides than the conduction structure and the at least one semiconductor light source. The latching hooks may, for example, be arranged completely on the front side of the carrier, partially projecting beyond the respective longitudinal side or projecting entirely beyond the respective longitudinal side.

There is an advantageous development for avoiding gaps between the diffuser film and the carrier as well as for providing particularly secure cohesion in which the carrier has, in the region of each of its two longitudinal sides, a plurality of latching hooks which are spaced apart on the longitudinal side.

The latching hooks can be embodied, for example, as barbs. The latching hooks can additionally be embodied as clamping elements.

There is also a refinement in which the at least one latching hook has been shaped from the carrier. As a result, it is possible to dispense with separately manufactured latching hooks, which makes assembly easier.

There is a development of this in which the latching hook has been shaped from the carrier, for example by punching the circuit board and bending over the punched region.

There is also a refinement in which the at least one latching hook has previously been manufactured separately and has then been attached to the carrier. This permits a particularly versatile form of the latching hook. The latching hook may be attached by means of an automatic equipping machine. The latching hook may be, for example, a component which is attached using surface mounted technology (SMT) or through-hole technology (THT) or pin-in-hole technology (PIH). An SMT equipping process may have the effect that no metallic surfaces are generated on the rear side. In the event of the carrier corresponding to the circuit board of the light strip, the at least one latching hook is attached to the circuit board.

There is an alternative development in which the at least one latching hook constitutes an integral part of the carrier and has therefore been manufactured together with the rest of the carrier. Such a carrier may have been manufactured, for example, by means of an extrusion method or may be an extruded part, for example composed of plastic or of metal (such as aluminum, copper etc.).

The latching hook which is attached to the carrier may secure the diffuser film alone. Alternatively, the latching hook may secure the diffuser film together with the carrier.

There is also a refinement in which the diffuser layer is bent over inward in the region of its longitudinal edges ("lateral edge region"). As a result, the free longitudinal edge can be inserted as a beveled latching region in at least one latching hook. In the case of an elastic diffuser layer, particularly secure latching can be achieved in the latching hook by virtue of the resilient force of said diffuser layer. This refinement can be implemented particularly easily.

There is also a refinement in which the diffuser layer can be compressed elastically in the circumferential direction, specifically in its latched state. This may permit a cross-sectional area which is surrounded by the diffuser layer to be reduced (for example for insertion into the glass bulb) under an external pressure and with automatic pressure release of the diffuser layer (for example after the insertion into the glass bulb). Secure bearing of the diffuser layer on the glass bulb can therefore be achieved.

There is a refinement in which the diffuser layer bears partially on an inner side of the glass bulb and is lifted off in its profile toward the carrier from the glass bulb. The lifted-off part of the diffuser layer is therefore located in cross section between the part bearing against the glass bulb and the carrier. The lifted-off part serves, owing to its deformability, as a spring region for bringing about the elastic compressibility of the latched diffuser layer. The bent part may for this purpose have a turning point in its profile along the cross section or be curved or dented in the direction of the interior of the bulb.

In addition, there is a refinement in which the at least one latching hook starts on the upper side of the circuit board at a distance from a longitudinal side of the circuit board. This assists the lifting off of the diffuser layer from the glass bulb at the junction with the carrier and therefore the provision of the spring region in a particularly easy way.

There is also a refinement in which the carrier is a strip-shaped carrier which is bent in a conformed fashion with respect to the glass bulb. As a result, particularly good transmission of heat from the rear side of the carrier to the glass bulb and consequently particularly good conduction of heat away from the at least one semiconductor light source may be achieved. In various embodiments, the carrier is flexible. The carrier corresponds, for example in this refinement, to the circuit board of the light strip.

There is also a refinement in which the carrier is a rigid, strip-shaped carrier which has edge regions which are bent over laterally in cross section and to which the diffuser film is latched. As a result, bearing on the glass bulb over a larger surface is achieved than with a non-bent-over strip-shaped carrier, which brings about more effective conduction of heat away from the at least one semiconductor light source. Small gaps between the carrier and the glass bulb may be filled with heat-conducting material such as a heat-conducting paste or the like. The carrier corresponds, for example, also to the circuit board of the light strip in this refinement.

In addition, there is also a refinement in which the carrier has a cross section whose curved rear side bears in a conformed fashion on the inner side of the glass bulb, and whose front side which is directed into the glass bulb has at least one planar region on which the light strip is arranged. In this way bearing over a large surface is achieved, thereby providing effective conduction away of heat even without deformation (for example elastic, elastic-plastic or plastic bending) of the carrier.

There is also additionally a refinement in which an outer side or rear side of the carrier which can be touched is electrically insulated from the conduction structure and therefore does not conduct a voltage.

There is a development in which in the event of the carrier and the circuit board being different components, the carrier consists completely of electrically insulating plastic and therefore itself for example does not have any voltage-conducting surfaces such as conductor tracks or the like. This development includes, for example, the fact that over its length the diffuser layer arches over the light strip and therefore cannot be touched itself. This provides the advantage that the light strip which bears, for example, with its rear side on the carrier, can also be provided on the rear side with a metallization (for example at least one conductor track, at least one contact field etc.) without adversely affecting the direct-contact protection. Alternatively, the carrier can be metalized on its side over which the diffuser layer arches.

There is a development in which in the event of the carrier and the circuit board forming the same component, the carrier or the circuit board is metalized only on its front side, and therefore does not have any electrically conductive surfaces such as conductor tracks or the like on its rear side. Since the diffuser film arches over the upper side, the direct-contact protection is also provided in this way.

Figure 2:
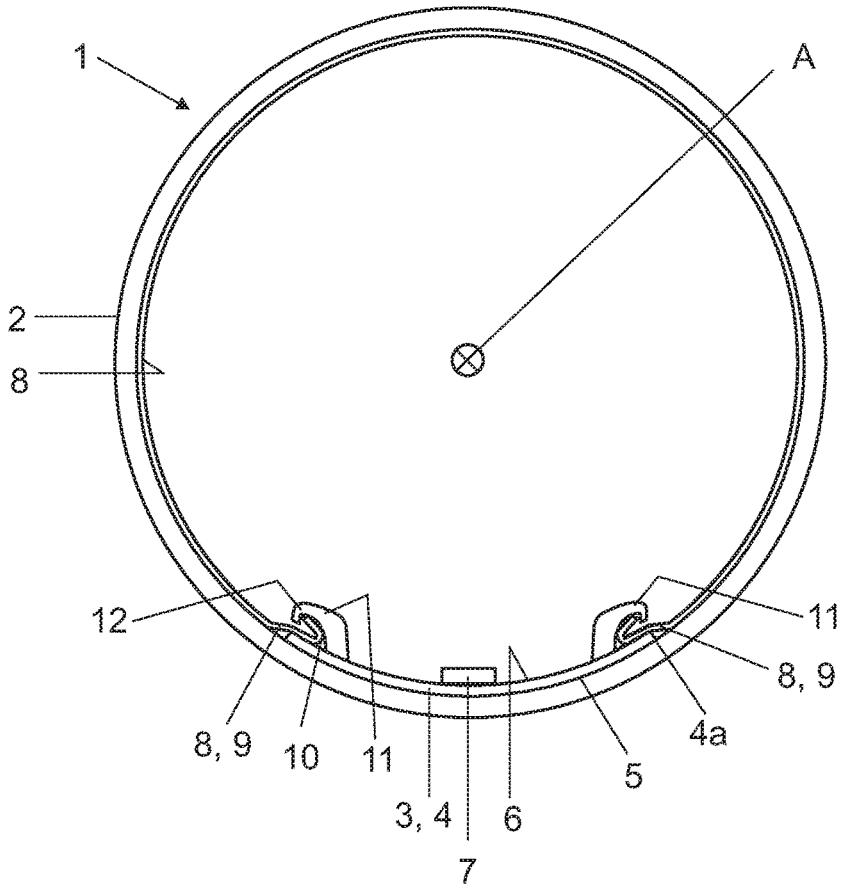
FIG. 2 shows the detail of the lamp according to the first embodiment as a sectional illustration in a front view.

FIG. 1 shows an oblique front view of a detail of a lamp 1 according to a first embodiment. FIG. 2 shows the detail of the lamp 1 as a sectional illustration in a front view.

The lamp 1 has a tubular, transparent glass bulb 2 with open end sides (top diagram). The glass bulb 2 has a profile-like longitudinal extent along a longitudinal axis A with a circular-ring-shaped cross section perpendicular to the longitudinal axis A. The detail has been selected here by way of example as a longitudinal section of the lamp 1 between rolled portions (not shown) of the glass bulb 2.

Inserted in the glass bulb 2 is a light strip 3, of which only the strip-shaped circuit board 4 is shown here. The board-shaped circuit board 4 (the thickness of which is therefore small compared to an extent in the lateral direction and in the longitudinal direction, for example at least one order of magnitude smaller) has a spherically curved cross-sectional shape. A degree of curvature corresponds to a degree of curvature on an inner side of the glass bulb 2. The circuit board 4 therefore bears with its rear side 5 in a conformed fashion on the glass bulb 2. The circuit board 4 may have already been pre-shaped in a curved fashion before its introduction into the glass bulb 2.

The circuit board 4 has on its front side 6 directed into the interior of the glass bulb 2 a plurality of LED chips 7 (not shown in FIG. 1) which are arranged in series in the longitudinal direction A. The LED chips 7 are electrically connected to at least one base (top diagram) of the lamp 1 via a conduction structure (top diagram) located on the front side 6, for example in a series circuit and/or in a parallel circuit. The LED chips 7 may emit white light. A separate carrier is dispensed with, or the circuit board 4 also corresponds to a carrier for the LED chips 7.

In addition, an elastic diffuser layer 8 is introduced into the glass bulb 2. The diffuser layer 8 arches over the circuit board 4 or the front side 6 thereof. It bears for the greater part in cross section on the inner side of the glass bulb 2, to be precise, for example, at a spatial angle of a maximum light flux of the light emitted by the LED chips 7. Just before the circuit board 4 is reached, the diffuser layer 8 lifts off from the glass bulb 2 and therefore has a lifted-off part 9 there. The lifted-off part 9 is contiguous with the circuit board 4 with an inwardly bent over or turned over lateral edge region 10 which ends at a longitudinal edge 13 (see, for example, FIGS. 4 and 5) of the diffuser layer 8. In this context, the lifted-off part 9 has a turning point in its profile. A measure of the lifting off is determined by a thickness of the circuit board 4.

The lateral edge region 10 engages in a plurality of latching hooks 11 of the circuit board 4 in a latching fashion. The latching hooks 11 are arranged in series along the longitudinal axis A, specifically on the front side 6 of the circuit board 4 in the region of each of the two longitudinal sides 4*a* of the circuit board 4. The diffuser layer 8 is therefore inserted bent in a tubular fashion in the glass bulb 2 and latches in the lateral edge region 10 of its longitudinal edges with the circuit board 4.

Figure 3:
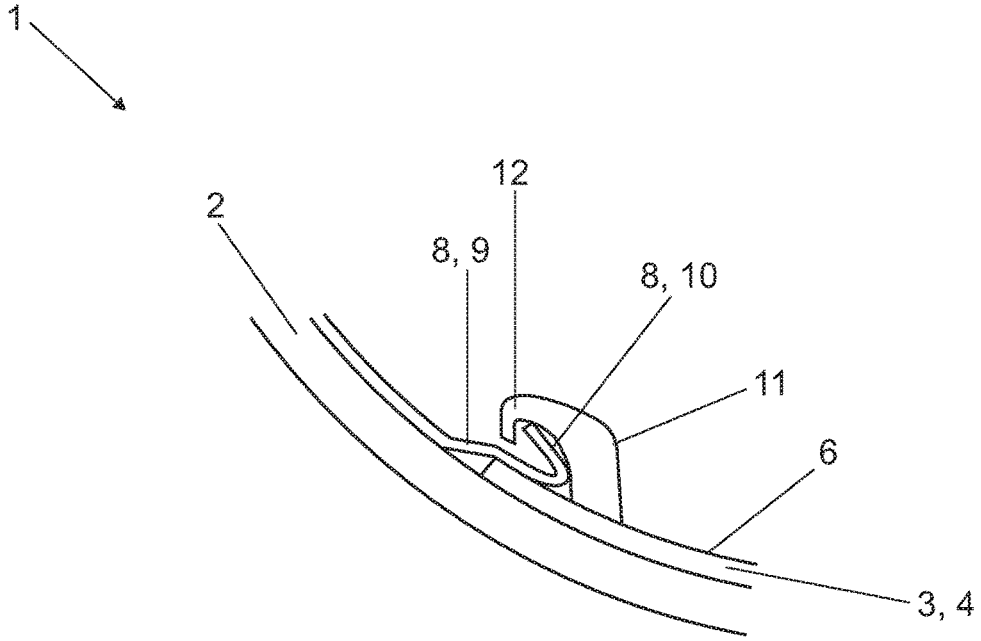
FIG. 3 shows an enlarged detail from FIG. 2.

FIG. 3 shows an enlarged detail from FIG. 2 in order to illustrate the latching arrangement. The latching hook 11 is attached to the upper side 6 of the circuit board 4 in such a way that it forms a receptacle for the edge region 10 of the diffuser layer 8 together with the circuit board 4. The latching hook 11 is for this purpose bent outward laterally and has, at its free end, a barb 12 which is bent over once more.

The edge region 10 of the diffuser layer 8 can simply be plugged into an opening ("mouth opening") formed by the latching hook 11. In this context, the edge region 10 is compressed elastically until the longitudinal edge has been inserted into the latching hook 11. After the longitudinal edge has passed the barb 12, the edge region 10 can expand again. In this context, the longitudinal edge of the diffuser layer 8 moves behind the barb 12 of the latching hook 11 and is secured there in a positively locking fashion against pulling out of the diffuser layer 8. The barb 12 therefore serves as a stop for the longitudinal edge of the diffuser layer 8.

As a result, secure latching is achieved in a simple way. The diffuser layer 8 bears here so tightly on the circuit board 4 that a finger, tool or the like will not pass through. The diffuser layer 8 therefore arches over the front side 6 of the circuit board with the conduction structure and the LED chips 7 in order to be directed against direct contact. Since the outside or rear side 5 of the circuit board 4 does not have an electrical connection to the front side 6, a base material of the circuit board 4 is electrically insulating (is composed for example of plastic) and in addition the diffuser layer 8 is composed of electrically insulating or dielectric material, the diffuser layer 8 and the circuit board 4 form a non-voltage-conducting protective sheath, connected permanently to one another, to prevent direct contact with the conduction structure and/or the LED chips 7 even in the event of the glass bulb 2 having been damaged.

In various embodiments, the circuit board 4 and the diffuser layer 8 could already have been latched to one another before insertion into the glass bulb 2, since this combination is self-supporting. For a simple insertion into the glass bulb 2, it may be provided that the diffuser layer 8 can be elastically compressed in its circumferential direction, specifically by means of elastic deformation of the lifted-off part 9. As a result, before insertion into the glass bulb 2, the circuit board 4 and the diffuser layer 8 can even have a cross section which is somewhat larger than the inner cross section of the glass bulb 2. By compressing the diffuser layer 8, its cross-sectional size can therefore be reduced to such an extent that the circuit board 4 and the diffuser layer 8 can easily be inserted into the glass bulb 2. If the external application of force to the diffuser layer 8 is released during or after the insertion, the lifted-off part 9 springs back, with the result that the diffuser layer 8 is pressed against the glass bulb 2. The diffuser layer 8 then also presses the circuit board 4 against the glass bulb 2.

The latching hooks 11 may have been pre-fabricated and only subsequently attached or mounted on the circuit board 4, for example by means of surface mounting. In various embodiments in the case of surface mounting the latching hooks 11 may be attached to the circuit board 4 in the same process step as surface-mountable LED chips 7 and, if appropriate, further electrical SMT components. The equipping with the latching hooks 11 which has taken place previously can take place within the scope of the equipping of the LED chips 7 and, if appropriate, of further electrical components on the circuit board 4.

Alternatively, the latching hooks 11 can have been shaped from the carrier. For this purpose, for example a thin circuit board may be provided with, for example, U-shaped punched portions, which are subsequently bent upward and then also bent over in a hook shape. This may be carried out using a tool. An effect here may be further simplification of the mounting and a cost saving through the elimination of separately manufactured hooks.

Figure 4:
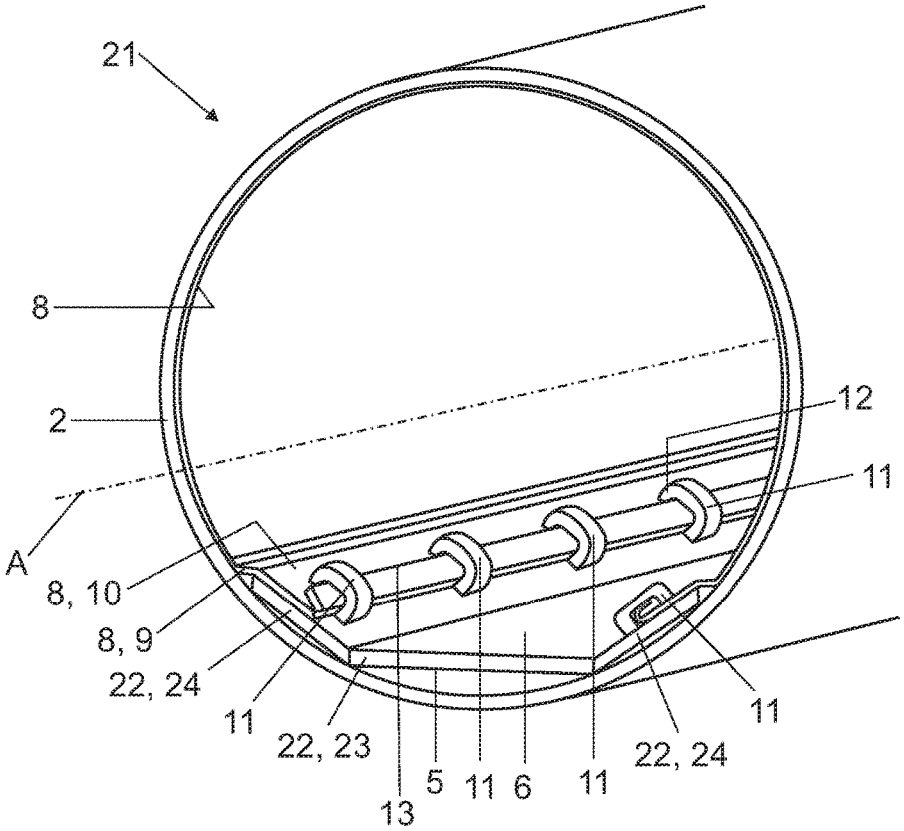
FIG. 4 shows an oblique front view of a detail of a lamp according to a second embodiment.

FIG. 4 shows an oblique front view of a detail of a lamp 21 according to a second embodiment in an illustration which is similar to FIG. 1.

Figure 5:
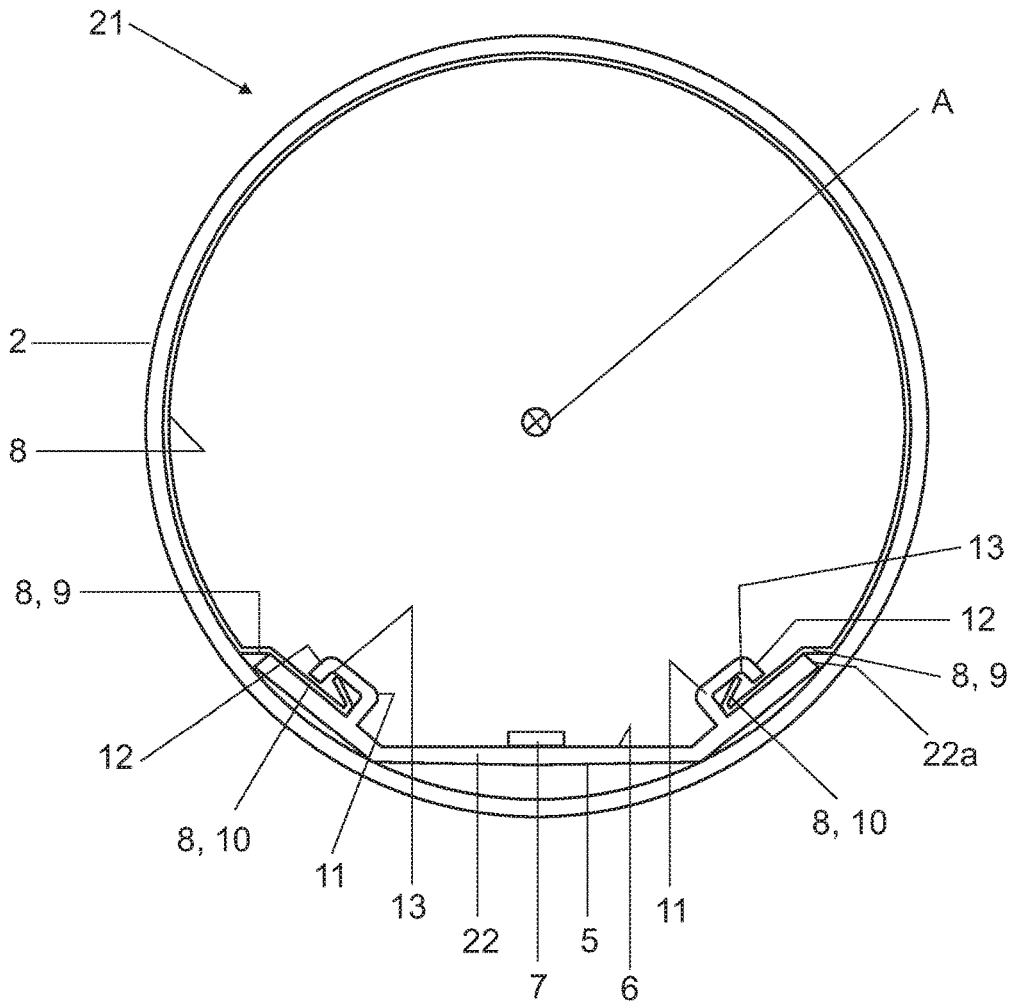
FIG. 5 shows the detail of the lamp according to the second embodiment as a sectional illustration in a front view.

FIG. 5 shows the detail of the lamp 21 as a sectional illustration in a front view in an illustration which is analogous to FIG. 2. The lamp 21 is configured in a similar way to the lamp 1, apart from the fact that a strip-shaped circuit board 22 has a virtually rigid base body with longitudinal sides 22*a*. A dedicated carrier is also dispensed with here, with the result that the light strip 7, 22 corresponds to a combination of the circuit board 22, of the at least one LED chip 7 and of the conduction structure.

In order to bring about improved bearing on the inner side of the glass bulb 2, the circuit board 22 has planar edge regions 24 which are bent over in cross section laterally from a planar central region 23 at corresponding bending lines. While the conduction structure and the LED chips 7 (see FIG. 5) are arranged on the front side 6 of the central region 23, the edge regions 24 have the latching hooks 11 on the front side.

Figure 6:
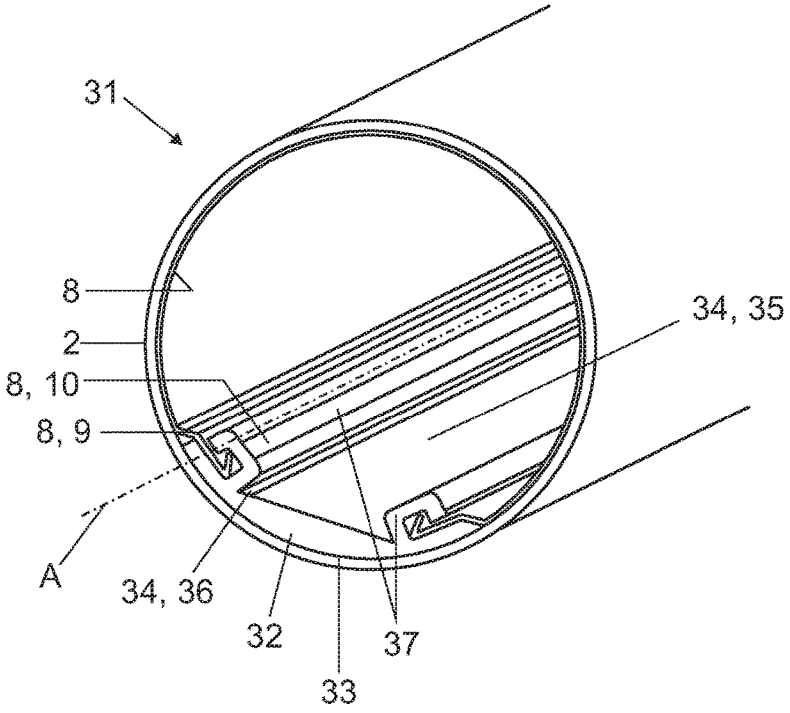
FIG. 6 shows an oblique front view of a detail of a lamp according to a third embodiment.

FIG. 6 shows an oblique front view of a detail of a lamp 31 according to a third embodiment in an illustration which is analogous to FIG. 4.

Figure 7:
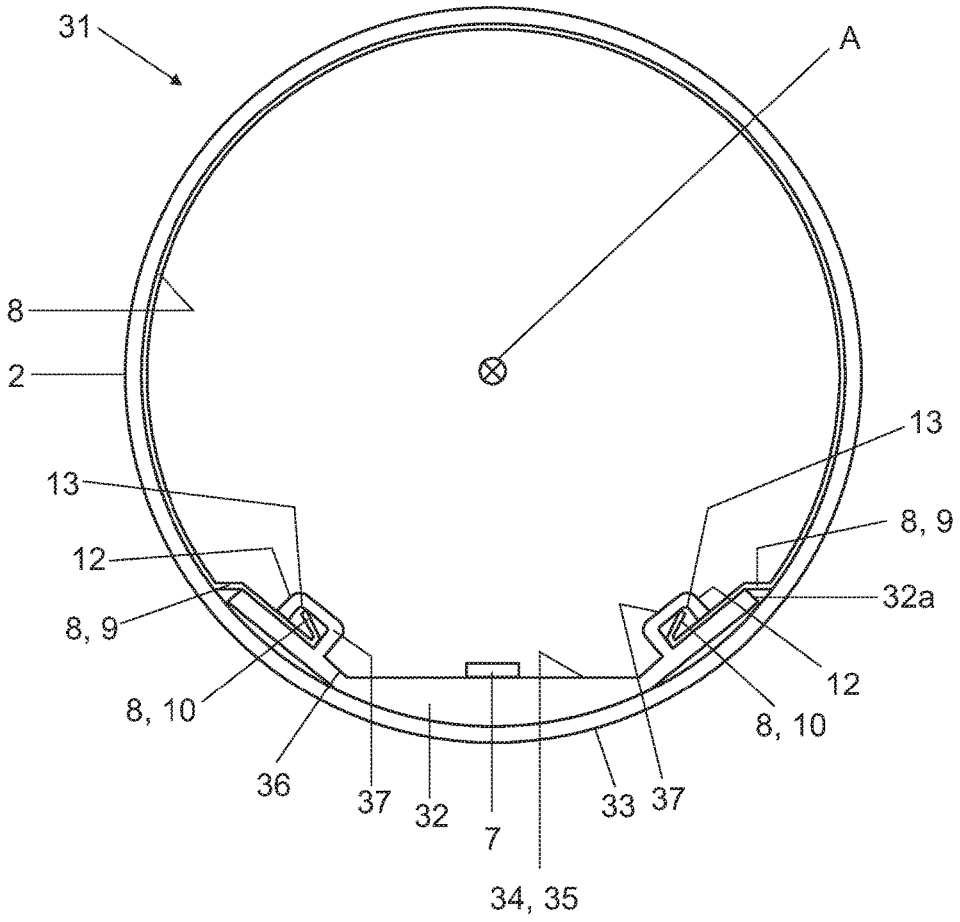
FIG. 7 shows the detail of the lamp according to the third embodiment as a sectional illustration in a front view.

FIG. 7 shows the detail of the lamp 31 in an illustration which is analogous to FIG. 5. The lamp 31 has a circuit board 32 with a cross-sectional shape of the base body, in which shape the circuit board 32 has a curved rear side 33 which bears in a conformed fashion on the glass bulb 2. A front side 34 of the circuit board 32 has, in contrast, a planar central region 35 similarly to the circuit board 22, which central region 35 bears the conduction structure and the LED chips 7. Lateral regions 36 which are each bent laterally in cross section and which bear the latching hooks 37 project from the central region 35 of the front side 34. The circuit board 32 (with longitudinal sides 32*a*), therefore does not have any constant thickness, but instead a variable thickness.

A dedicated carrier is also dispensed with here, with the result that the light strip 7, 32 corresponds to a combination of the circuit board 32, of the at least one LED chip 7 and of the conduction structure.

In addition, the latching hooks 37 are then no longer bounded in the direction of the longitudinal axis A or extend only locally. Instead, the latching hooks 37 are then formed in a profile-like fashion or uninterrupted longitudinally and therefore are part of the general profile shape of the circuit board 32. This refinement can be permitted particularly easily if the circuit board 32 or the base body thereof is implemented as an extruded part.

Figure 8:
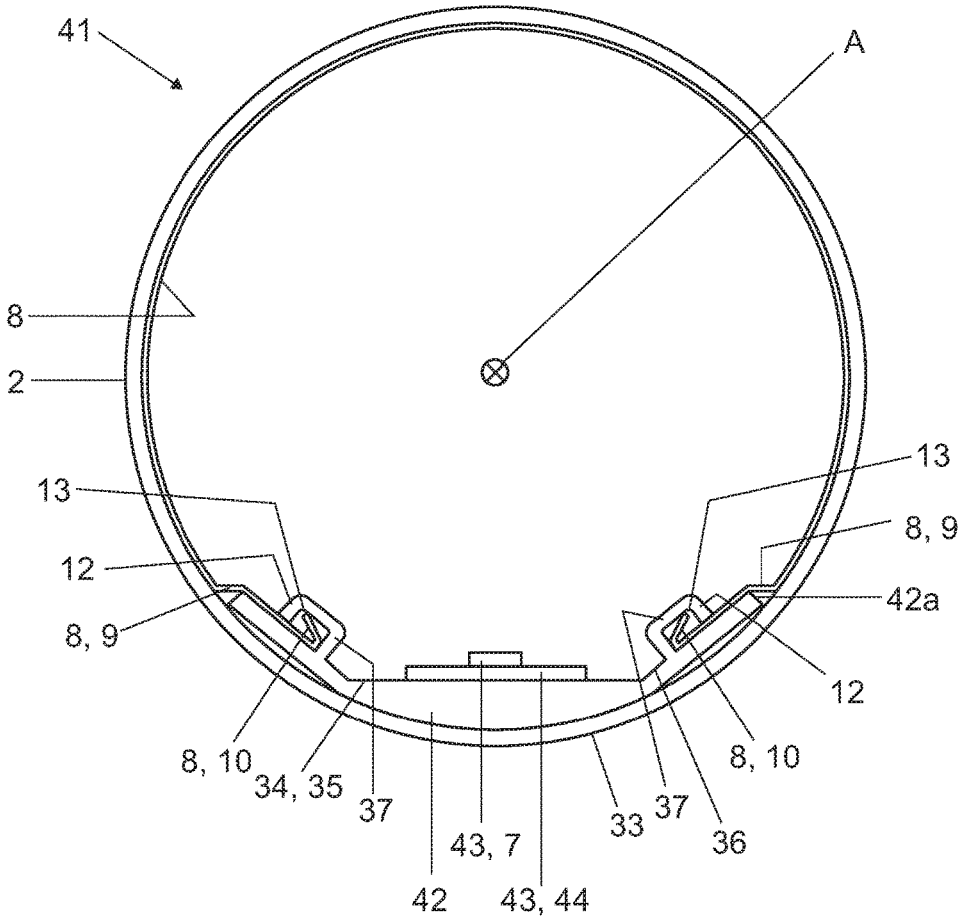
FIG. 8 shows a detail of a lamp according to a fourth embodiment as a sectional illustration in a front view.

FIG. 8 shows a detail of a lamp 41 according to a fourth embodiment in an illustration which is analogous to FIG. 7.

The lamp 41 is embodied similarly to the lamp 31, but now has a carrier 42 and a light strip 43 as separate or separately manufactured components. This may permit particularly easy manufacture of the carrier 42 with longitudinal sides 42*a*, for example by means of an extrusion method. In various embodiments, the light strip 43 may now have a planar circuit board 44 which bears with its rear side on the carrier 42 and bears the LED chips 7 and the conduction structure on the front side (top diagram). This may provide the effect that conventional light strips can be used without adaptation, or without complex adaptation. The light strip 43 may be, for example, bonded, wedged and/or latched to the carrier 42 (top diagram). In this way, the light strip 43 may be attached to the carrier 42 by means of a double-sided adhesive strip.

The carrier 42 may be composed of dielectrical material such as plastic. This may have the effect that the circuit board 44 of the light strip 43 can also conduct voltage on its contact surface with the carrier 42 without direct-contact protection being adversely affected. In addition, plastic can be shaped easily and cost-effectively.

In various embodiments, if the circuit board 44 has the conduction structure and the LED chips 7 only on the front side and therefore does not have a voltage-conducting region on its contact face with the carrier 42, as an alternative to the construction from dielectric material such as plastic, the carrier may be composed of metal (for example aluminum). The carrier 42 can then serve as a heat sink and improve the conduction of heat away from the LED chips 7.

Generally, "one", "a" or "an" etc. can be understood to refer to a single number or to a plurality, for example in the sense of "at least one" or "one or more" etc. as long as this is not explicitly ruled out, for example by the expression "precisely one" etc.

A statement of a number may also include precisely the specified number as well as a customary tolerance range as long as this is not explicitly ruled out.

LIST OF REFERENCE SYMBOLS

1 Lamp
2 Glass bulb
3 Light strip
4 Circuit board
5 Rear side of the circuit board
6 Front side of the circuit board
7 LED chip
8 Diffuser layer
9 Lifted-off part of the diffuser layer
10 Lateral edge region of the diffuser layer
11 Latching hook
12 Barb
13 Longitudinal edge
21 Lamp
22 Circuit board
23 Central region
24 Edge region
31 Lamp
32 Circuit board
33 Curved rear side
34 Front side
35 Central region
36 Lateral region
37 Latching hook
41 Lamp
42 Carrier
43 Light strip
44 Circuit board
A Longitudinal axis While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A lamp, comprising:
a tubular glass bulb with open end sides;
at least one elongate carrier, inserted into the glass bulb, for at least one light strip;
at least one elastic diffuser layer which is introduced into the glass bulb; and
two bases which are fitted onto the open end sides of the glass bulb;
wherein the at least one light strip has a strip-shaped circuit board with a front-side conduction structure and with at least one semiconductor light source which is electrically connected thereto;
wherein the conduction structure is electrically connected to at least one of the bases;
wherein the at least one diffuser layer arches over the at least one semiconductor light source and the at least one conduction structure in a contact-free configuration at least over a length between the bases;
wherein the at least one diffuser layer is latched to the at least one carrier,
wherein the at least one diffuser layer is inserted bent cylindrically into the glass bulb and is latched, in the region of its longitudinal edges, to the carrier, and
wherein the carrier has, in the region of each of its two longitudinal sides, at least one latching hook into which latching hook the diffuser layer is latched.

2. The lamp of claim 1,
wherein the at least one carrier corresponds to the at least one circuit board.

3. The lamp of claim 1,
wherein the lamp has precisely one carrier and precisely one diffuser layer.

4. The lamp of claim 1,
wherein the at least one latching hook is shaped from the carrier.

5. The lamp of claim 1,
wherein the at least one latching hook is attached to the carrier.

6. The lamp of claim 1,
wherein the diffuser layer is bent over inward in the region of its longitudinal edges.

7. The lamp of claim 1,
wherein the diffuser layer can be compressed elastically in the circumferential direction.

8. The lamp of claim 1,
wherein the diffuser layer bears partially on an inner side of the glass bulb and is lifted off from the glass bulb toward the carrier.

9. The lamp of claim 1,
wherein the carrier is a strip-shaped carrier which is bent in a conformed fashion with respect to the glass bulb.

10. The lamp of claim 1,
wherein the carrier is a rigid, strip-shaped carrier which has edge regions which are bent over laterally in cross section and to which the diffuser layer is latched.

11. The lamp of claim 1,
wherein the carrier has a cross-sectional shape whose curved rear side bears in a conformed fashion on the inner side of the glass bulb, and whose front side which is directed into the glass bulb has at least one planar region on which the light strip is arranged.

12. The lamp of claim 1,
wherein a rear side of the carrier which can be touched is electrically insulated from the conduction structure.

* * * * *